US012528613B2

(12) United States Patent
Soria et al.

(10) Patent No.: US 12,528,613 B2
(45) Date of Patent: Jan. 20, 2026

(54) GASSING RAIL FOR GAS OR STEAM FLUSHING CONTAINERS AND CAPS ON A ROTARY CAPPING MACHINE

(71) Applicant: Excel Packaging Consulting, LLC, Big Rock, IL (US)

(72) Inventors: Francisco J. Soria, Big Rock, IL (US); Koon H. Wong, Deerfield, IL (US)

(73) Assignee: Excel Packaging Consulting, LLC, Big Rock, IL (US)

( * ) Notice: Subject to any disclaimer, the term of this patent is extended or adjusted under 35 U.S.C. 154(b) by 0 days.

(21) Appl. No.: 18/640,997

(22) Filed: Apr. 19, 2024

(65) Prior Publication Data

US 2025/0171180 A1 May 29, 2025

Related U.S. Application Data

(63) Continuation-in-part of application No. 18/520,903, filed on Nov. 28, 2023, now Pat. No. 12,397,947.

(51) Int. Cl.
*B65B 31/04* (2006.01)

(52) U.S. Cl.
CPC ..... *B65B 31/041* (2013.01)

(58) Field of Classification Search
None
See application file for complete search history.

(56) References Cited

U.S. PATENT DOCUMENTS

2003/0159408 A1* 8/2003 Seebeger ..... B65B 7/2807 53/471

* cited by examiner

*Primary Examiner* — Chinyere J Rushing-Tucker
(74) *Attorney, Agent, or Firm* — IpHorgan Ltd.

(57) ABSTRACT

The present invention provides a gassing rail for gas or steam flushing containers and caps on a rotary capping machine. The gassing rail defines an inner side and an outer side with respect to the rotary capping machine, the gassing rail includes a generally planar body, an upper surface formed on the generally flat planar body, the upper surface having at least one cap gas or steam distribution slot defining a longitudinally extending cap path, the cap gas or steam distribution slot includes an infeed end and an exit end, a lower surface formed on the generally flat planar body, the lower surface having at least one container gas or steam distribution slot defining a longitudinally extending container path, the container gas or steam distribution slot includes an infeed end and an exit end, a bore extends through the gassing rail generally between the outer side and the inner side of the gassing rail, the bore defining a fluid passage having an inlet located at the outer side and an outlet located at an area of the inner side; and a fitting coupled to the inlet at the outer side, the fitting adapted to be coupled to a tubing supplying a source of gas or steam, whereby the source of gas or steam is routed from the outer side to the outlet at the inner side via the bore. In another embodiment, the present invention provides a gassing rail for gas or steam flushing containers and caps on a rotary capping machine, the gassing rail defines an inner side and an outer side with respect to the rotary capping machine. The gassing rail includes a generally planar body, an upper surface formed on the generally flat planar body, the upper surface having at least one cap gas or steam distribution slot defining a longitudinally extending cap path, the cap gas or steam distribution slot includes an infeed end and an exit end, a lower surface formed on the generally flat planar body, the lower surface having at least one container gas or steam distribution slot defining a longitudinally extending container path, the container gas or steam distribution slot includes an infeed end and an exit end, an inner flange side gassing rail is coupled to the planar body along the inner side, the inner flange side gassing rail having at least one container gas or steam side distribution slot defining a (Continued)

longitudinally extending container path, and an outer flange side gassing rail is coupled to the planar body along the outer side, the outer flange side gassing rail having at least one container gas or steam side distribution slot defining a longitudinally extending container path.

25 Claims, 11 Drawing Sheets

GASSING RAIL FOR GAS OR STEAM FLUSHING CONTAINERS AND CAPS ON A ROTARY CAPPING MACHINE

CROSS REFERENCE TO RELATED APPLICATIONS

This application is a continuation-in-part application claiming the benefit of parent application Ser. No. 18/520,903 filed Nov. 28, 2023. The parent application is incorporated by reference herein in its entirety.

FIELD OF THE INVENTION

The present invention relates to gassing rail assembly for flushing gas or steam during packaging process and, in particular, for a capping machine.

BACKGROUND OF THE INVENTION

The food packaging industry includes systems which provide a transport system to move containers through product fill stations. The transport system then moves the filled containers to capping systems. The capping systems include automatic handling of caps which are secured to the filled container. The caps may be screw-type caps, or other. The cap may include a foil seal with adhesive or similar sealing mechanism. Capping systems include rotary and single head capping systems. Some applications require that the capping systems run at a high-speed to provide a high-production volume. Throughout the product filling and capping stages, the containers are in constant movement along a transport or conveyer system. The transport system supports the containers and includes means of lateral support and guidance of the container along the transport system. Such guidance may include a longitudinally extending rail for linear movement of the containers. Alternatively, the guidance may include star wheels and guides for non-linear movement, such as through a capping station. The various supporting and guidance systems may be provided at various elevations with respect to the container. In such systems, at the point where the containers filled with product converge with the capping system, the capping system may include an overhead chuck which applies the cap to the moving container and secures the cap to the container via spinning action, or as appropriate. As will be appreciated, the containers are often embedded in a maze of various high-speed transporting, guiding, and processing stations. Accordingly, additional access to the containers is significantly limited.

The prior art in the food packaging industry also includes gassing rail systems for flushing gas during packaging process. The flushing gas is used to displace an undesirable gas from an open container during the packaging process. The flushing occurs in advance of closing or sealing the container. U.S. Pat. No. 5,682,723 is directed to an apparatus and method for purging air from open containers holding various types of products. Such gassing rail systems generally run along a linear path with the flushing gas system suspended over the open containers.

Gassing rails used in a capping machine are constrained in the area where the containers and cap converge, leaving limited space for gassing rails. In some applications it is necessary to omit a portion of the final gassing stage. Other problems may relate to delays in maintenance of the system. In addition, the prior art gassing rails are less effective in steam applications, such as required for certain baby liquid formulas.

SUMMARY OF THE INVENTION

In one embodiment, the present invention provides a gassing rail for gas or steam flushing containers and caps on a rotary capping machine. The gassing rail defines an inner side and an outer side with respect to the rotary capping machine, the gassing rail includes a generally planar body, an upper surface formed on the generally flat planar body, the upper surface having at least one cap gas or steam distribution slot defining a longitudinally extending cap path, the cap gas or steam distribution slot includes an infeed end and an exit end, a lower surface formed on the generally flat planar body, the lower surface having at least one container gas or steam distribution slot defining a longitudinally extending container path, the container gas or steam distribution slot includes an infeed end and an exit end, a bore extends through the gassing rail generally between the outer side and the inner side of the gassing rail, the bore defining a fluid passage having an inlet located at the outer side and an outlet located at an area of the inner side; and a fitting coupled to the inlet at the outer side, the fitting adapted to be coupled to a tubing supplying a source of gas or steam, whereby the source of gas or steam is routed from the outer side to the outlet at the inner side via the bore.

In another embodiment, the present invention provides a gassing rail for gas or steam flushing containers and caps on a rotary capping machine, the gassing rail defines an inner side and an outer side with respect to the rotary capping machine. The gassing rail includes a generally planar body, an upper surface formed on the generally flat planar body, the upper surface having at least one cap gas or steam distribution slot defining a longitudinally extending cap path, the cap gas or steam distribution slot includes an infeed end and an exit end, a lower surface formed on the generally flat planar body, the lower surface having at least one container gas or steam distribution slot defining a longitudinally extending container path, the container gas or steam distribution slot includes an infeed end and an exit end, an inner flange side gassing rail is coupled to the planar body along the inner side, the inner flange side gassing rail having at least one container gas or steam side distribution slot defining a longitudinally extending container path, and an outer flange side gassing rail is coupled to the planar body along the outer side, the outer flange side gassing rail having at least one container gas or steam side distribution slot defining a longitudinally extending container path.

DETAILED DESCRIPTION OF THE INVENTION

Figure 1:
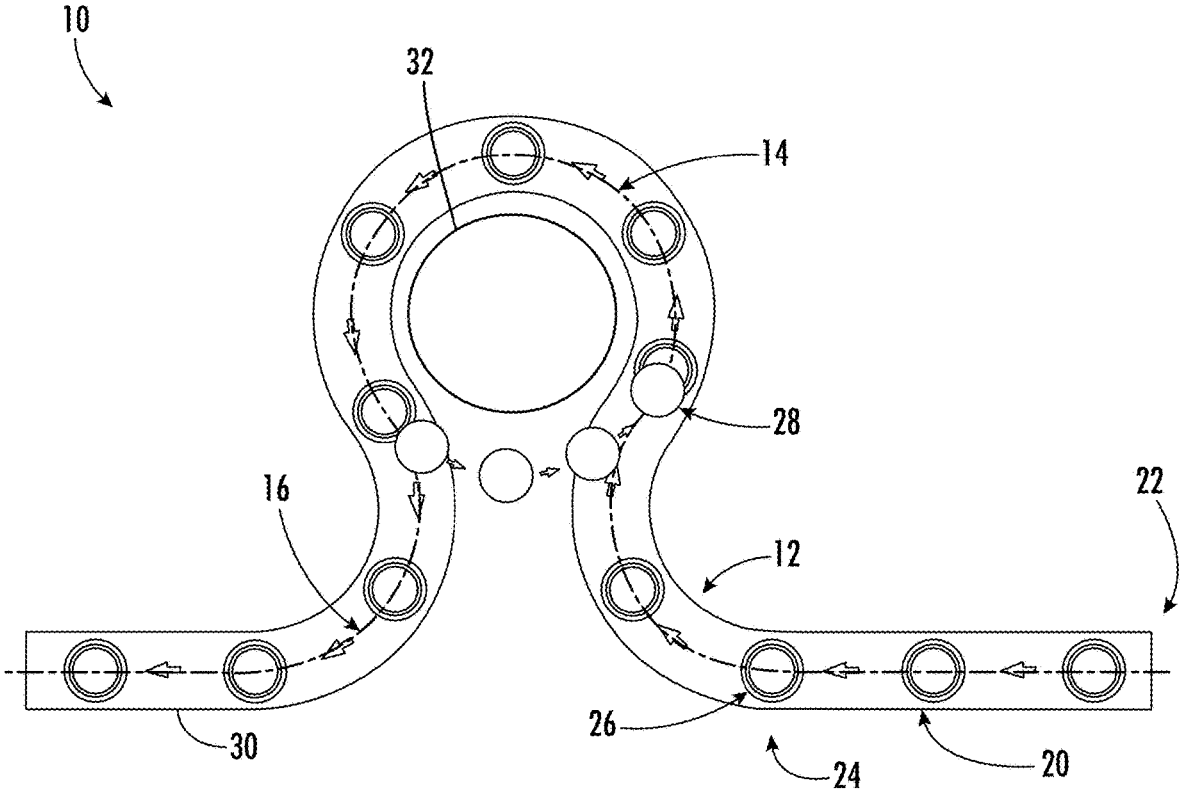
FIG. 1 is a plan diagram representing a rotary capping machine of the prior art.

FIG. 1 is a plan diagram which represents a generic rotary capping machine 10 of the prior art. In general, each machine 10 has three curved paths, an infeed 12, main 14 and discharge 16. FIG. 1 is representative of but one example. Each section of capping machine has an infeed or proximal end and a discharge or distal end. The rotary capping machine of FIG. 1 includes a straight infeed conveyor system 20 which includes an infeed end 22 and a discharge end 24. The straight infeed conveyor system transports containers 26 in the direction towards the capper curved infeed path. The capper curved infeed path represents a transfer system for moving the containers off the straight infeed conveyor system and onto the rotary capping machine. From there, the containers are transported to the capper curved main path which represents a capper curved main transfer system or rotary capping machine, where caps 28 are secured to the container. From there, the containers move to a capper curved discharge path. The capper curved discharge path is a transfer system for moving the containers, which have now been capped, from the rotary capping machine to the straight discharge conveyor system 30. In the generic rotary capping machine of FIG. 1, the path of the containers can be seen to move from the straight conveyor, to the capper infeed curve, through the capper main path, out of the capper main path via the capper discharge curve, and then to the straight discharge conveyor.

The center rotary structure 32 supports the plurality of chucks (not shown). The chucks receive caps and move them into the capper main path, in a manner which converge with the containers moving along the capper infeed curve as the containers enter the capper main path. With a cap secured in the jaws of a chuck, the chuck converges with the path of a container entering the capper main path. The cap is held just above the container, and is then lowered onto the moving container, and secured to the container. For screw caps, the chuck will rotate the cap onto the threads of the container. It will be appreciated that the continuous, high speed, movement of the chucks and caps, as they merge in the path of the continuous, high speed, movement of the containers, renders problematic the use of traditional overhead gas flushing of the containers as they move into the capper main path, prior to being capped.

Figure 2:
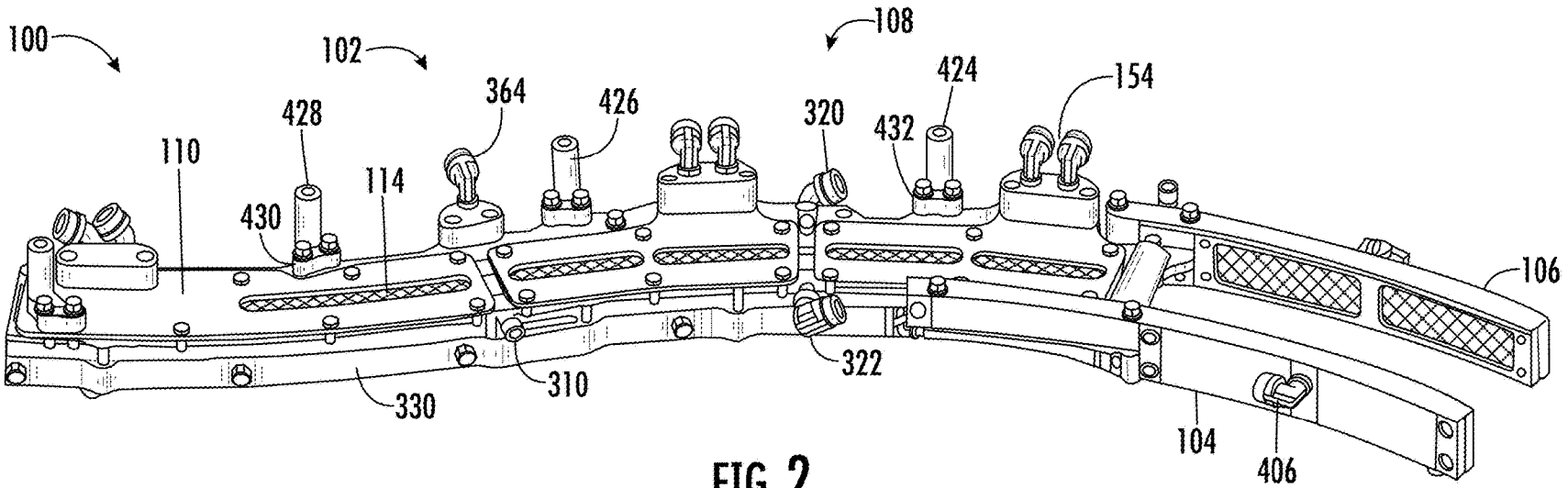
FIG. 2 is a perspective view of the gassing rail system for gas and steam flushing containers and caps, of a first embodiment of the present invention.

FIG. 2 is a perspective view of the gassing rail system 100 for gas and steam flushing containers and caps, of the present invention, which may be used with the generic prior art rotary capping machine 10. The plurality of chucks suspended and operated by the prior art center rotary structure 32 are in continuous movement in a manner to coincide with a respective container entering the main path of the rotary capping machine. The gassing rail system 100 of the present invention is shown to include a container and capper gassing rail 102 and two curved longitudinally extending side gassing rails 104, 106. A transfer gassing rail may be coupled to the infeed end of the gassing rail, with a straight gassing rail coupled to the infeed end of the transfer gassing rail.

The straight gassing rail purges the container headspace. Thereafter, the curved transition or transfer gassing rail purges the containers 26 during the capper infeed curved path. The container and capper gassing rail is designed to provide a low profile so that it may be located between respective converging container 26 and cap 28 and reduce the time for maintenance. The container and capper gassing rail 102 continues the purging of the opened container and cap.

After the container and respective cap are purged and advance past the gassing rail 102, the cap and container converge vertically from a first position having a maximum spaced apart distance to a final position where the cap and container are engaged and sealed. From the first to the final position, the container head space and cap cavity are again exposed. For this reason, the two curved longitudinally extending side gassing rails 104, 106 are provided. The side gassing rails are on either side of the container and cap between the first and final positions, in a cap fastening area, and provide a gas cloud to protect this open space. The invention is designed that all gassing ports are on the side opposite the center rotary structure, so that tubing may be reduced or eliminated in the area of the center rotary structure and both curved longitudinally extending side gassing rails are included. The invention is also designed to accommodate the use of steam for applications such as certain liquid baby formula.

FIGS. 2-10 show the gassing rail 102 of the first embodiment includes a generally planar body 108 providing an upper surface 110 and a lower surface 112. The planar body includes three zones. The upper surface of each zone provides at least one independent cap gas or steam distribution slot 114. The slot defines a longitudinally extending cap path having an infeed end and an exit end. The lower surface 112 of each zone provides at least one independent container gas or steam distribution slot 116. The slot defines a longitudinally extending container path having an infeed end and an exit end.

Figure 8A:
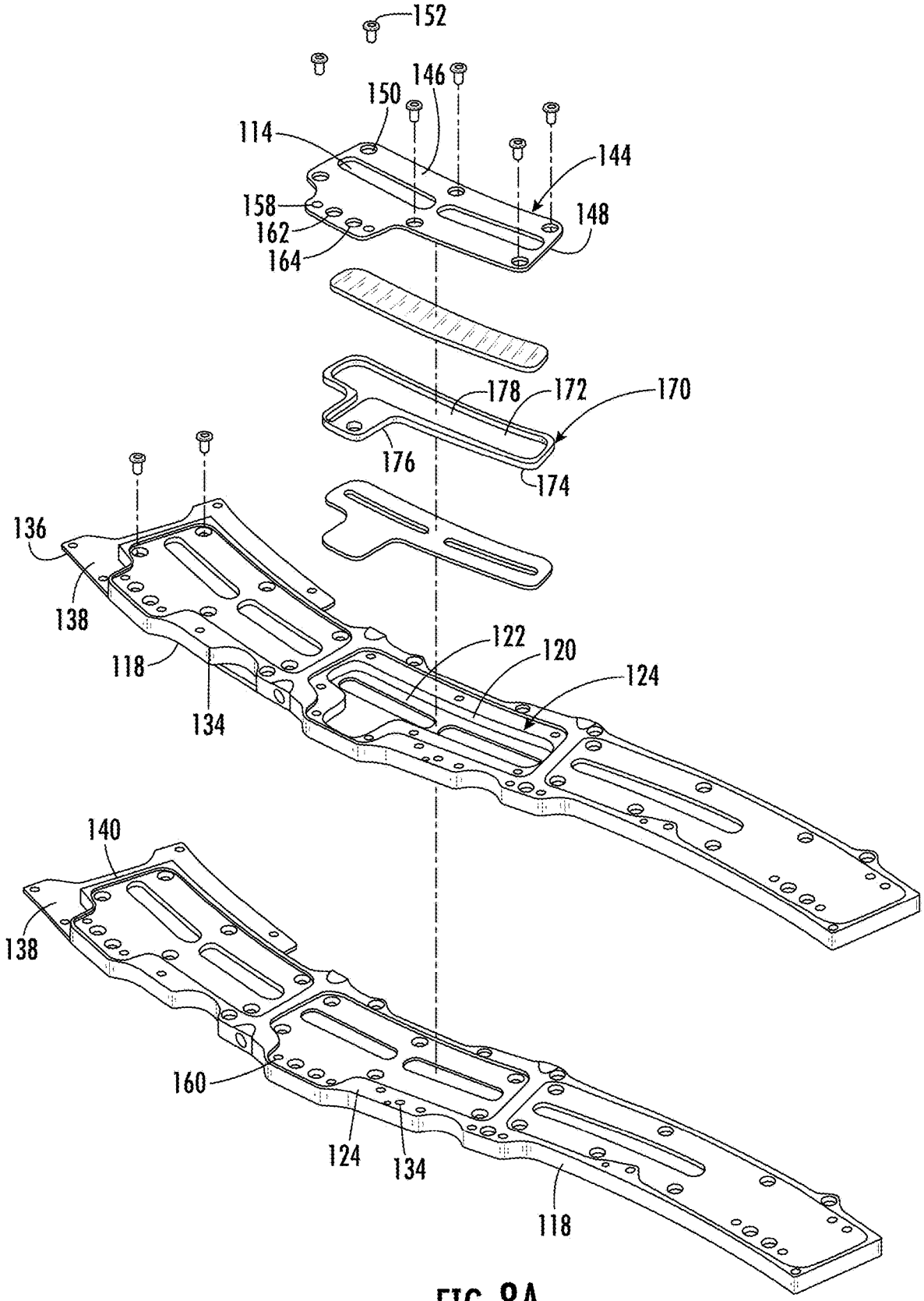
FIGS. 8A and 8B are each a partial exploded perspective view of a case of the gassing rail system of FIG. 2.
Figure 8B:
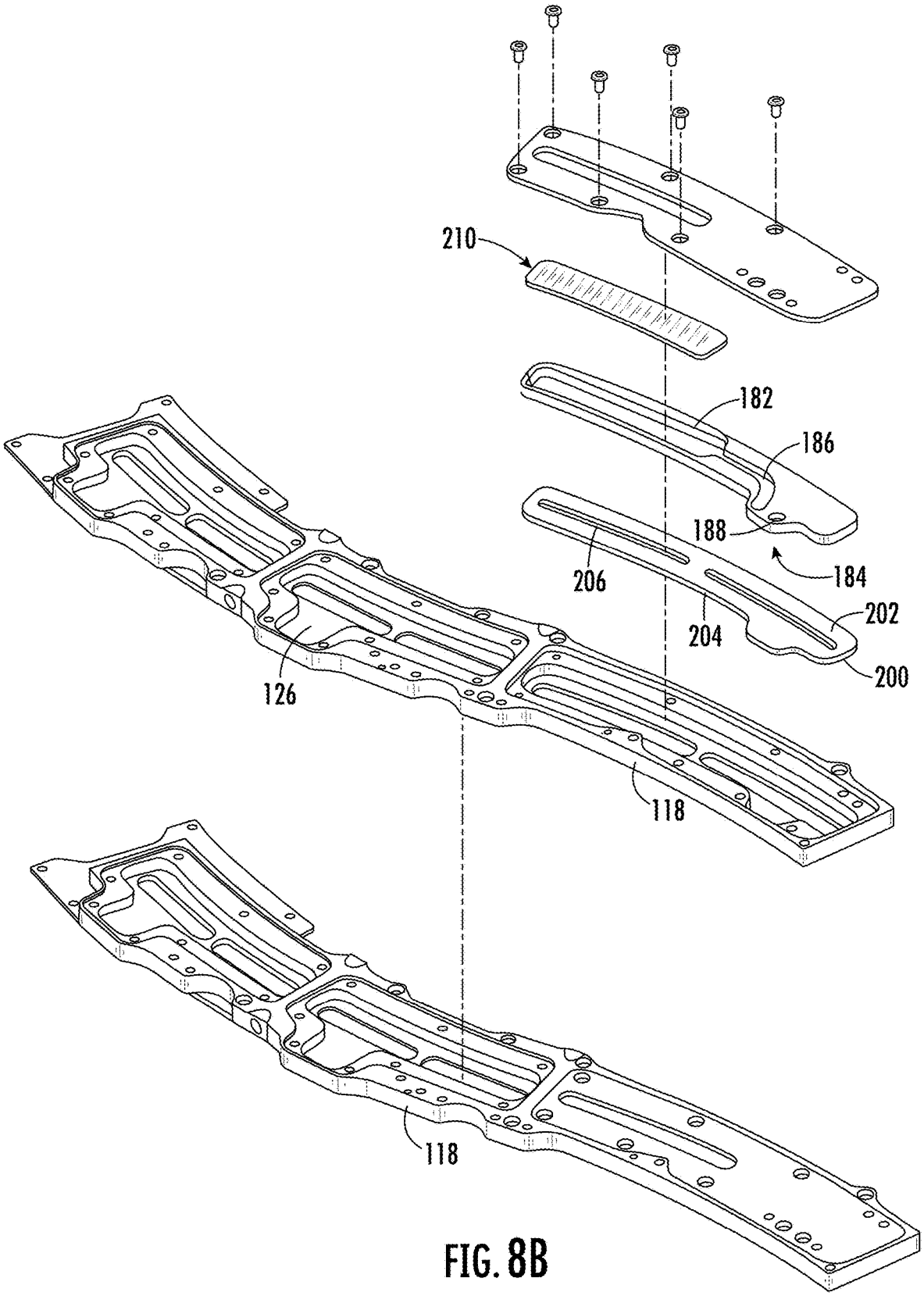

FIGS. 8A and 8B is an exploded view of the gassing rail 102. The gassing rail includes a lower case 118 providing the three zones. Zone 1 is the infeed end of the case and Zone 3 is the exit end of the case. A cavity 120 is formed in each of the zones. Each cavity 120 is defined by a bottom wall 122 and a side wall 124, the bottom wall includes an upper interior surface 126, a lower surface 128, and at least one independent container gas or steam distribution slots 116. The side wall includes a recessed seat 130 along the perimeter of the side wall. The side wall forms an extended portion 132 of the cavity. Threaded openings 134 are provided on the side wall, and through holes 136 are provided on the mounting flanges 138 defined by the bottom wall. The mounting flange on the inner side is shown to extend longitudinally longer than the mounting flange on the outer side. The distal end of the mounting flanges are connected by a web 140 which provides a mounting surface at the discharge end 142 of the gassing rail. The gassing rail includes a top cover 144 having the upper surface 146 and a bottom surface 148. The top cover includes at least one independent cap gas or steam distribution slots 114 and a plurality of through holes 150 for receiving threaded fasteners 152 to secure the top cover to the lower case. Dual port blocks 154 include threaded fasteners 156 which are received by a pair of through holes 158 in the top cover and by a pair of threaded openings 160 on the lower case. A cap port opening 162 and a container port opening 164 are provided on the top cover.

An insert 170 is provided between the lower case and the top cover. The insert includes an upper surface 172, a lower surface 174 and a side edge 176. An upper cavity 178 is formed in the upper surface and is defined in part by a cavity wall 182. The upper cavity generally extends along the cap path. A recessed seat extends along a portion of a perimeter of the upper cavity in the area of the cap path. The insert includes a tab portion 184. A groove 186 is formed in the upper surface and extends from the upper cavity to a location below and in fluid communication with the cap port opening of the top cover. A through hole 188 is at a location below and in fluid communication with the container port opening of the top cover. A lower cavity 190 is formed in the lower surface and is defined in part by a cavity wall 192. The lower cavity generally extends along the container path and tab portion. The through hole is shown to be located in the tab portion of the lower cavity.

A bottom gassing element 200 is provided and includes a plan shape similar to the insert. The bottom gassing element includes a top layer 202 and a bottom layer 204. The top layer is constructed of a 2-ply stainless steel mesh and includes a plurality of slots 206 aligned with the container gas distribution slots. The bottom layer is constructed of a 5-ply stainless steel mesh.

A top gassing element 210 is provided and includes a plan shape similar to the upper cavity of the insert and extends generally along the cap path. The top gassing element is constructed of a 5-ply stainless steel mesh.

The bottom gassing element 200 is received in the cavity of the lower case in facing engagement with the upper interior surface. The insert is received in the recessed seat of the lower case with the lower surface of the insert in engagement with the bottom gassing element, and the cavity wall of the lower cavity in a spaced apart relationship with the bottom gassing element. The top gassing element is received in the upper cavity of the insert in a spaced apart relationship with the cavity wall of the upper cavity. The lower surface of the top cover is in engaging with the upper surface of the insert and the top gassing element. The threaded fasteners of the dual port block assembly extend through the through holes of the top cover and are threaded into the threaded openings of the lower case.

Figure 5A:
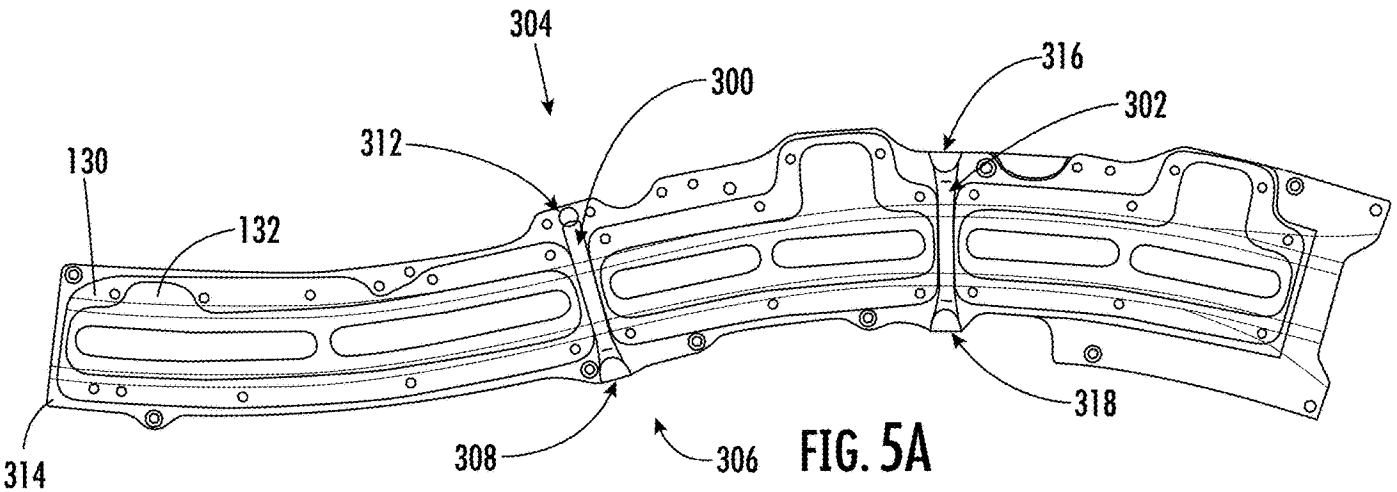
FIG. 5A is a top view of the case of the gassing rail system shown in FIG. 2.
Figure 5B:
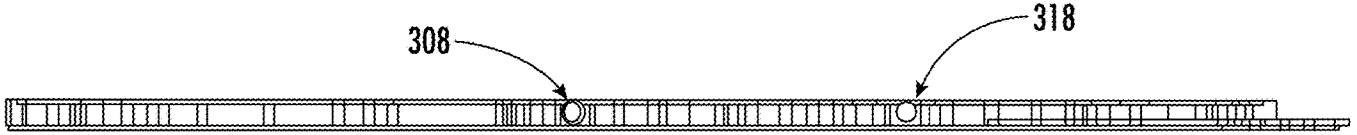
FIG. 5B is a side view of the case of the gassing rail system shown in FIG. 2.
Figure 5C:
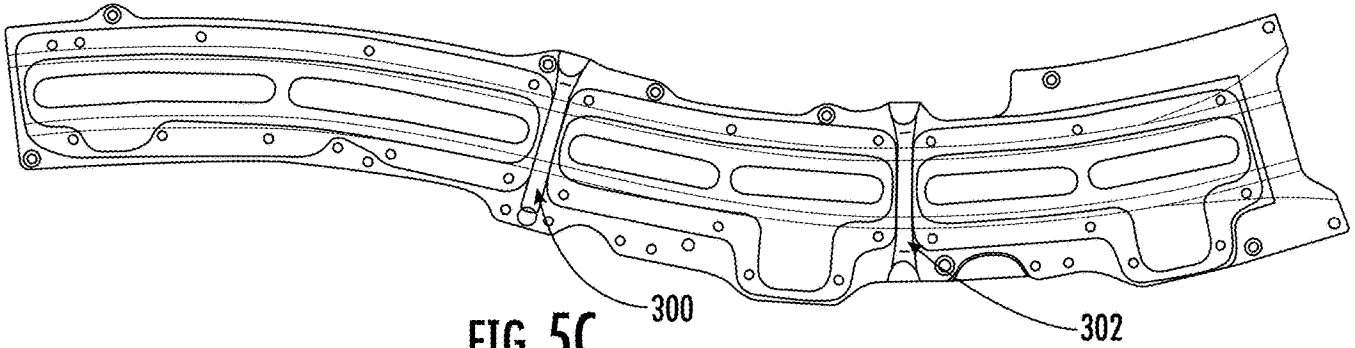
FIG. 5C is a bottom view of the case of the gassing rail system shown in FIG. 2.

FIGS. 5A-5C show that the lower case includes a bore 300 extending between zone 1 and zone 2, and another bore 302 extending between zone 2 and zone 3. Both bores extend between the outer side 304 and the inner side 306 of the gassing rail. The bore 300 includes a threaded opening 308 at the inner side for receiving a plug 310. An orthogonally machined opening 312 extends upward from the bore 300 at the outer side and opens at the upper mounting surface 314 of the lower case. Optionally, the bore 300 may extend into a threaded opening at the outer side for receiving a fitting or threaded plug. The other bore 302 includes a threaded opening 316, 318 at the outer side and at the inner side for receiving a fitting 320, 322.

Figure 4:
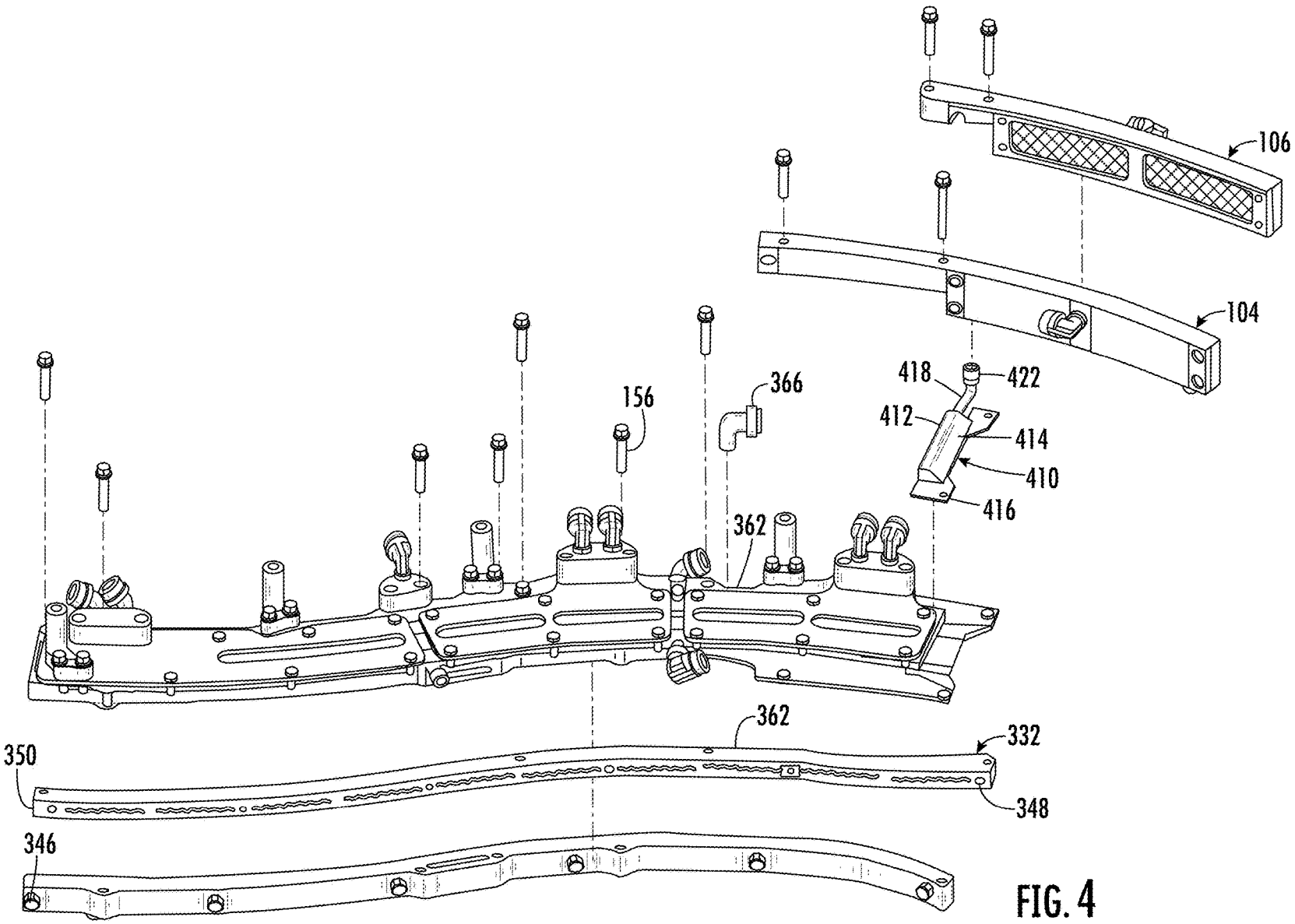
FIG. 4 is a partial exploded view of the gassing rail system of FIG. 2.
Figure 6:
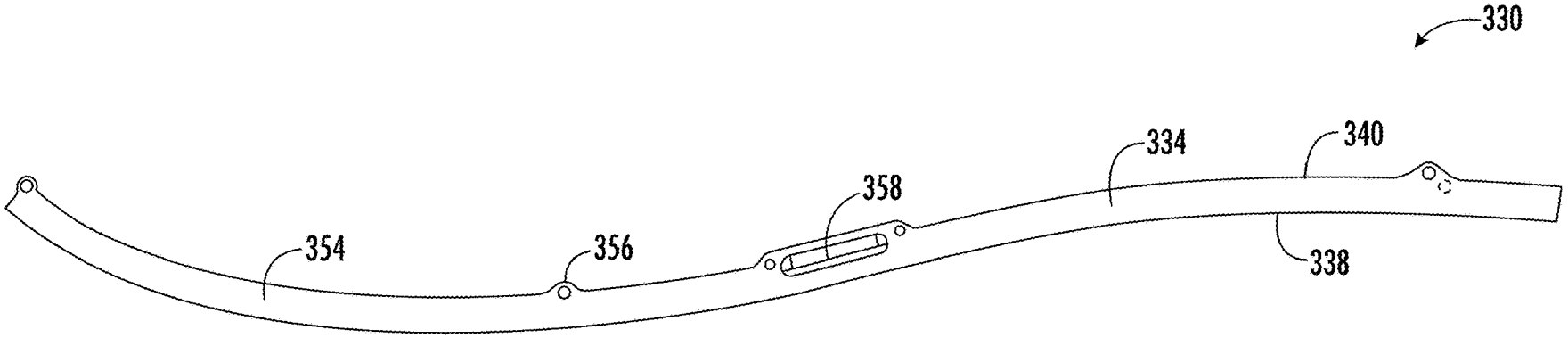
FIG. 6 is top view of an inner flange side gassing rail.
Figure 7:
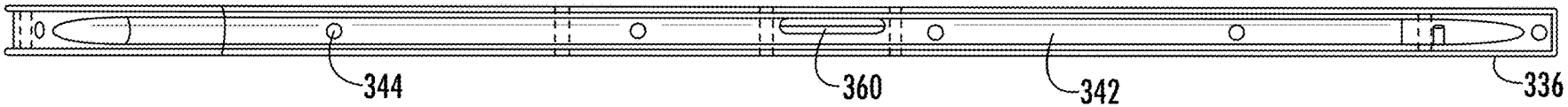
FIG. 7 is an inner side view of the inner flange side gassing rail, seen in FIG. 2.

FIG. 4 is a partial exploded view of the gassing rail and shows the inner flange side gassing rail 330 and the outer flange side gassing rail 332. FIGS. 6 and 7 are top view and inner side view, respectively, of the inner flange side gassing rail. However, as will be understood, the outer flange side gassing rail shares many similar features. Each of the inner and outer flange side gassing rail includes an upper surface 334, lower surface 336, outer side 338 and an inner side 340, wherein at least one container gas or steam side distribution slot 342 is located on the inner side. The inner side further includes through holes 344 for receiving fasteners 346 from the outer side, to be received in threaded openings 348 of a frame 350. The frame secures an element 352 within the container gas or steam side distribution slot. The element includes multiple layers. The upper surface includes a mounting surface 354 and a plurality of threaded openings 356. The inner flange side gassing rail further includes an inlet 358 located on the upper surface which is in fluid communication with an outlet 360 formed in the groove. The outer flange side gassing rail further includes an inlet 362 located on the outer side which is in fluid communication with an outlet formed in the groove.

Figure 3:
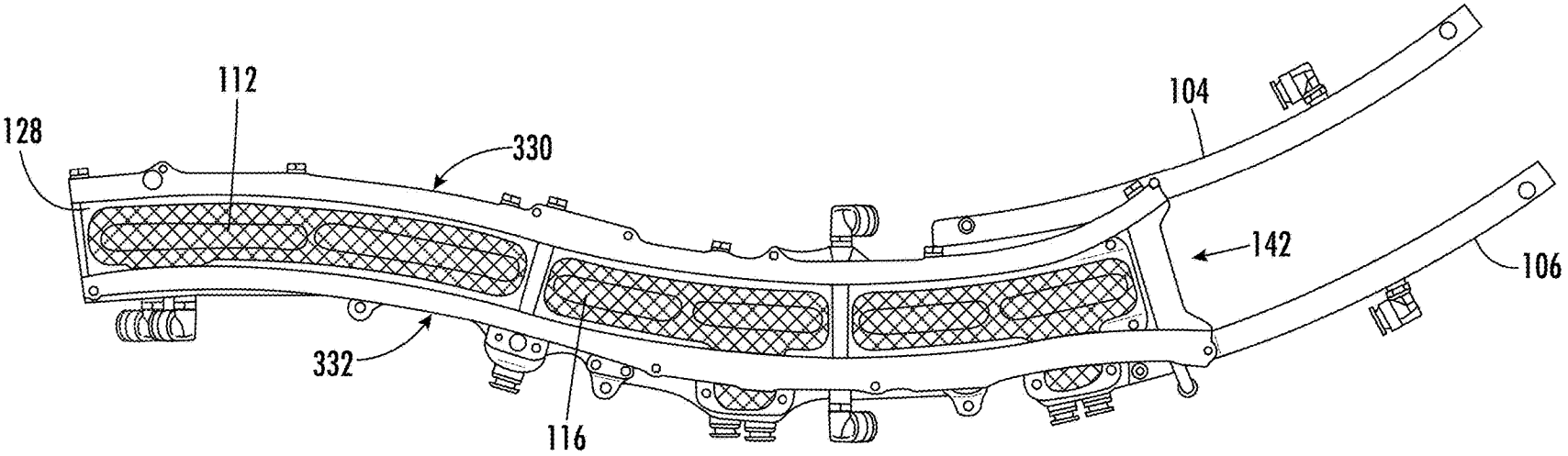
FIG. 3 is a bottom view of the gassing rail system of FIG. 2.
Figure 9:
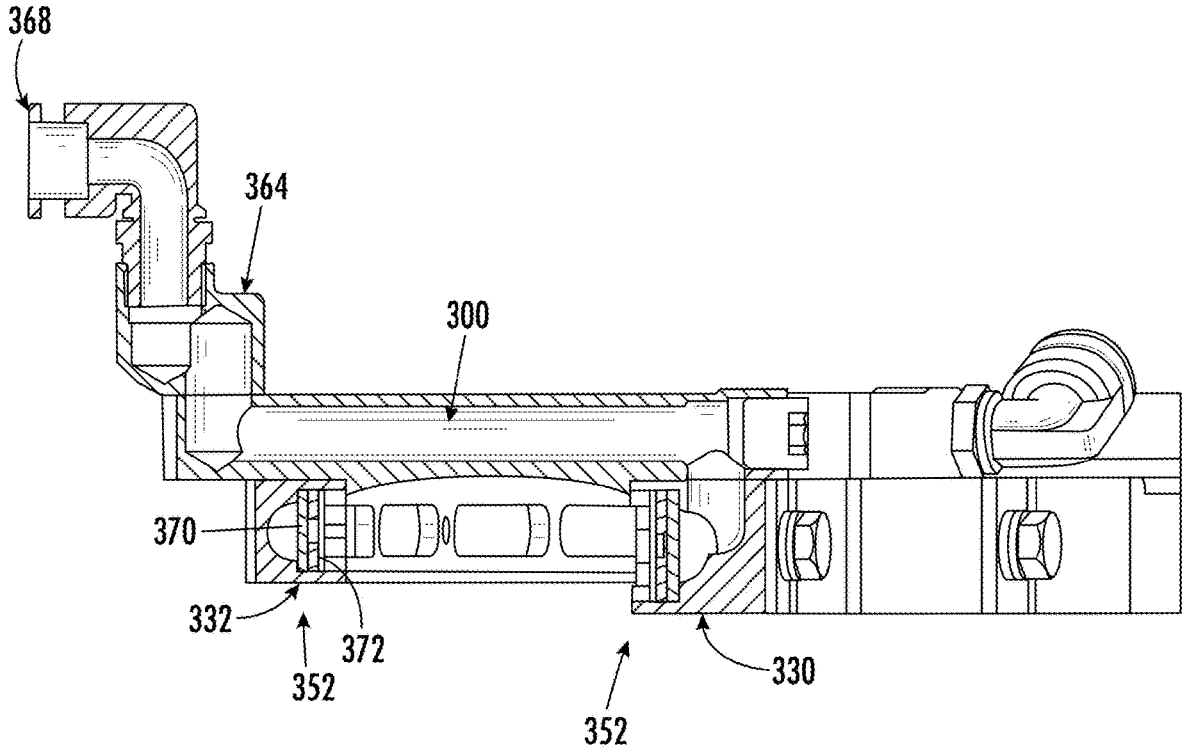
FIG. 9 is a partial cross sectional view of the gassing rail as seen from between zone 1 and 2 of FIG. 2.

FIGS. 2 and 3 show the inner flange side gassing rail 330 and the outer flange side gassing rail 332 secured to lower mounting surface 128 of the case. A port block 364 is coupled to the upper surface of the gassing rail and is in fluid communication with the bore 300 and the container gas or steam side distribution slot of the inner flange side gassing rail 330. A fitting 366 is coupled to the inlet 362 located on the outer side of the outer flange side gassing rail and is in fluid communication with the container gas or steam side distribution slot of the outer flange side gassing rail 332. FIG. 9 is a partial cross sectional view of the gassing rail as seen from between zone 1 and zone 2 of FIG. 2. A fitting 368 is shown coupled to the port block 364 and is in fluid communication with the bore 300. The bore is in fluid communication with the container gas or steam side distribution slot of the inner flange side gassing rail. The fitting 366 is in fluid communication with the container gas or steam side distribution slot of the outer flange side gassing rail. Each container gas or steam side distribution slot includes the multilayer element 352. The multilayer element has three layers. The two layers 370 received adjacent the respective slot are is 5 ply, whereas the layer 372 which is in direct contact with the frame is 2 ply.

Figure 10:
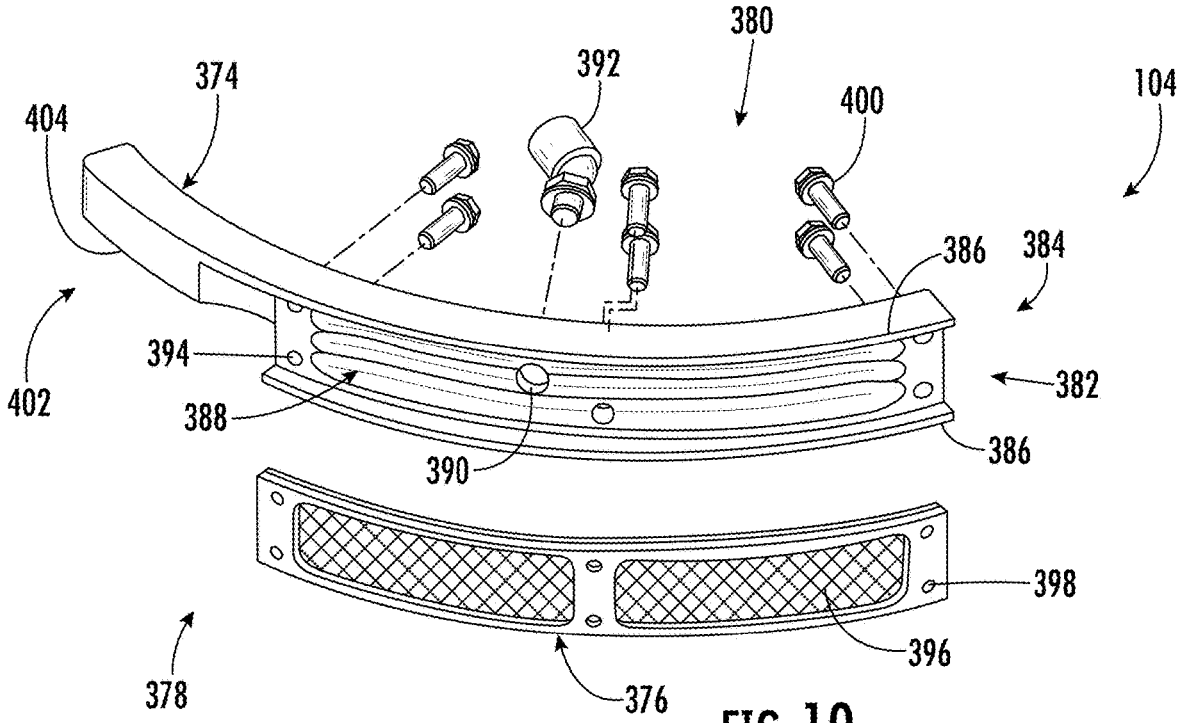
FIG. 10 is an exploded view of the inner side gassing rail of FIG. 2.

FIG. 4 includes an exploded view of the inner and outer curved longitudinally extending side gassing rail of FIGS. 2 and 3. FIG. 10 is an exploded view of the inner curved longitudinally extending side gassing rail 104. The inner and outer curved longitudinally extending side gassing rails include a curved case 374 and a curved frame 376. The case is machined from a single curved rectangular shaped component, which may be formed from metal. The case has an inboard and outboard side 378, 380. The inboard side is further machined to provide rectangular shaped recess 382 over a majority of its length extending form the distal end to nearly the proximal end, and forming recessed face 384 and two edges 386. Three parallel longitudinally extending grooves 388 are formed in the recessed face. A side rail port opening 390 extends through the rail from the outboard side to the grooves on the inboard side. A side rail port fitting 392 is coupled to the side rail port opening. Through holes 394 extend through the rail from the outboard side to the inboard side. A mesh baffle 396 is provided and includes a frame 376 and three layers of mesh spot welded together. The frame includes threaded openings 398 to receive respective threaded fasteners 400. A notch 402 is formed in the case at the proximal end to form a reduced profile proximal end, providing a mounting surface 404 where a threaded opening is formed for mounting to the curved transition bottom rail. The outer curved longitudinally extending side gassing rail is identical to the inner curved longitudinally extending side gassing rail, with the exception that the inboard side of the outer curved longitudinally extending side gassing rail is concave shaped and the inboard side of the inner curved longitudinally extending side gassing rail is convex shaped.

FIGS. 2 and 3 show the fitting 320 on the outer side of the gassing rail which is in fluid communication via the bore 302 with the fitting 322 on the inner side of the gassing rail. The fitting 322 on the inner side of the gassing rail is coupled to the fitting 406 on the inner curved longitudinally extending side gassing rail via tubing 408.

FIG. 4 is a partial exploded view and shows the invert gas rail 410 also shown in FIGS. 2 and 3. The invert gas rail includes a main housing 412 having a mesh gas outlet 414, wherein the housing is secured to a pair of mounting flanges 416. The mounting flanges are secured to the mounting flanges of the lower case. A tubing 418 extends from the main housing and is routed through a passage way 420 formed in the outer curved longitudinally extending side gassing rail. A fitting is coupled to the tubing. The fitting 422 is coupled to a source of gas or steam and is in fluid communication with the mesh gas outlet.

FIGS. 2-4 disclose a plurality of upright support structures 424. The upright support structures include a tubular main body 426 having a threaded opening 428 at an upper portion of the main body. The lower portion of the main body includes a base 430 which each receive two threaded fasteners 432 for securing the upright support structure to the upper surface of the gassing rail. The upper portion of the support structure is adapted to be secured to a mounting frame. The mounting frame may include means for attachment to the center rotary structure 32 of the rotary capping machine 10. In this manner, as the center rotary structure is initially adjusted for the height of the next run of container, the gassing rail system of the present invention is simultaneously adjusted as well.

Figure 11:
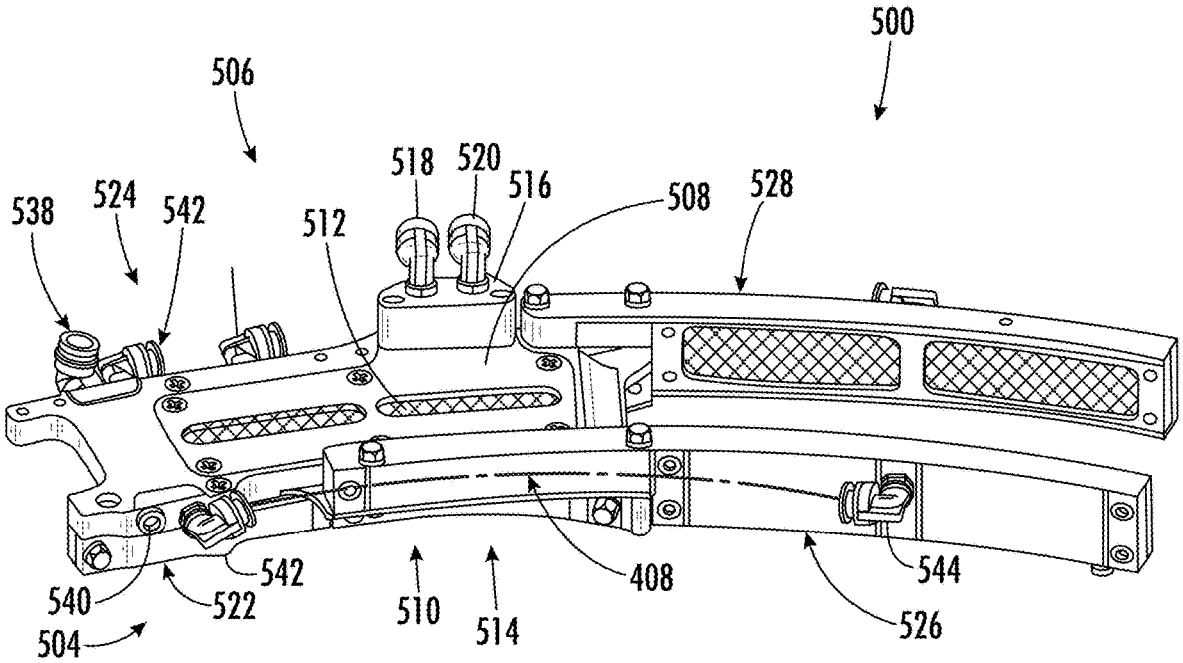
FIG. 11 is a perspective view of the gassing rail system for gas and steam flushing containers and caps, of a second embodiment of the present invention.
Figure 12:
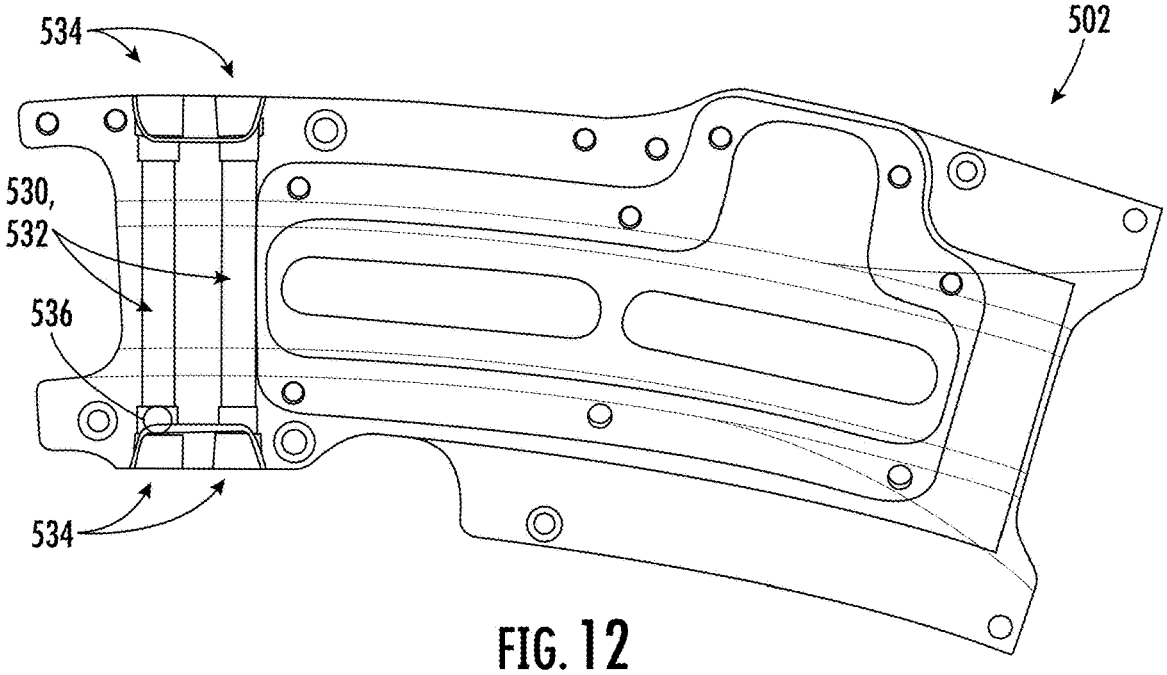
FIG. 12 is a top view of the case of the gassing rail system of FIG. 11.

FIG. 11 is a perspective view of the gassing rail system 500 for gas and steam flushing containers and caps, of a second embodiment of the present invention. The second embodiment shares many similar features to the first embodiment. FIG. 12 is a top view of the lower case 502 of the gassing rail system of FIG. 11. The gassing rail 504 of the second embodiment includes a generally planar body 506 providing an upper surface 508 and a lower surface 510. The planar body includes one zone. The upper surface of the zone provides at least one independent cap gas or steam distribution slot 512. The slot defines a longitudinally extending cap path having an infeed end and an exit end. The lower surface of the zone provides at least one independent container gas or steam distribution slot 514. The slot defines a longitudinally extending container path having an infeed end and an exit end. A port block 516 is coupled to the upper surface of the gassing rail. The container fitting 518 is in fluid communication with the independent container gas or steam distribution slot. The cap fitting 520 is in fluid communication with the independent cap gas or steam distribution slot.

The inner flange side gassing rail 522 and the outer flange side gassing rail 524, similar to the first embodiment, are shown secured to the lower surface of the lower case.

The gassing rail includes the inner and outer curved longitudinally extending side gassing rail 526, 528, similar to the first embodiment.

Two bores 530, 532 extend in a parallel manner adjacent one another at the infeed end of the lower case. Both bores are shown to end through the lower case with threaded openings 534 at each end.

The proximal located bore 530 includes an orthogonally machined opening 536 which extends downward from the bore 530 at the inner side of the gassing rail and is in fluid communication with the inlet located on the upper surface of the inner flange side gassing rail. A fitting 538 is coupled to the inlet on the outer side of the lower case and is in fluid communication with the container gas or steam side distribution slot of the inner flange side gassing rail. A threaded plug 540 is received by the threaded opening at the inner side of the lower case.

The distal located bore 532 includes a fitting 542 at each of the threaded openings. Tubing 408 connects the fitting 5423 at the inner side of the distal bore with the fitting 544 of the inner curved longitudinally extending side gassing rail.

Figure 13:
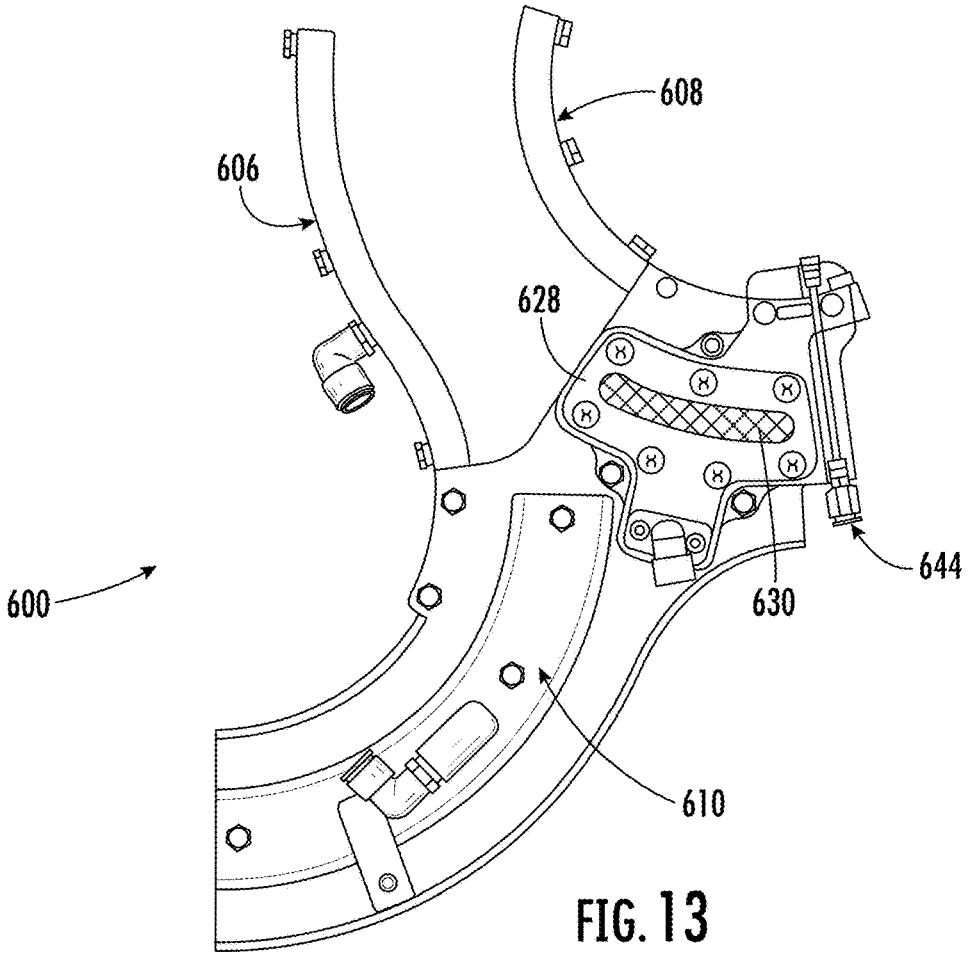
FIG. 13 is a top view of the gassing rail system for gas flushing containers and caps, of a third embodiment of the present invention.
Figure 14:
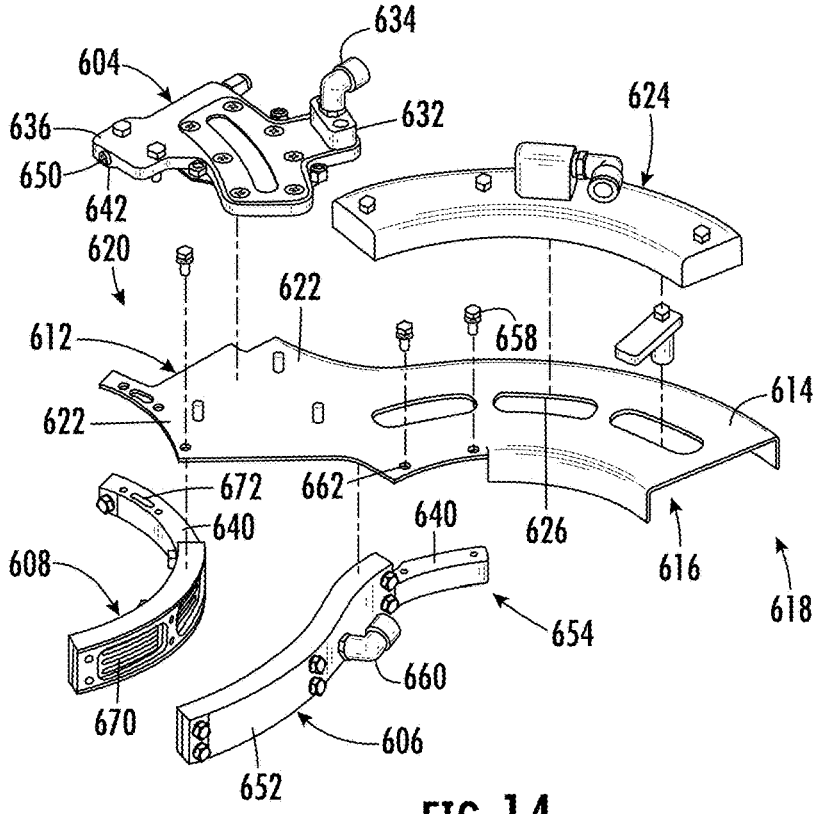
FIG. 14 is an exploded view of the gassing rail system of FIG. 13.
Figure 15:
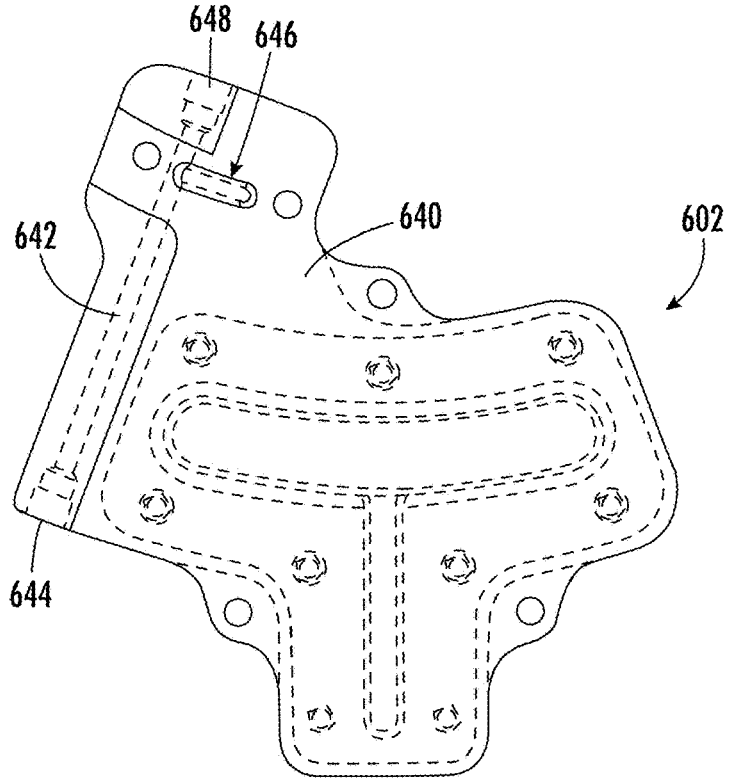
FIG. 15 is a bottom view of the case of the gassing rail system of FIG. 13.

FIG. 13 is a top view of the gassing rail system 600 for gas flushing containers and caps, of a third embodiment of the present invention. The third embodiment shares many similar features to the first and second embodiments. FIG. 14 is an exploded view of the gassing rail system of FIG. 13. FIG. 15 is a bottom view of the case 602 of the gassing rail system of FIG. 13.

The gassing rail system includes the invert gassing rail 604 for cap purging, two curved, outer and inner, longitudinally extending side gassing rails 606, 608, and a transition or transfer curve gassing rail system 610. The transfer curve gassing rail system includes a curved transition rail bottom 612 having a top surface 614, a lower surface 616, an infeed end 618 and a discharge end 620. The discharge end includes two flanges 622 extending laterally having a top surface and a bottom surface, the flanges may provide a mounting surface for the two curved longitudinally extending side gassing rails. The top surface of the curved transition rail bottom provides a mounting surface for the invert gassing rail and the rail top assembly or transfer gassing rail 624. The lower surface of the curved transition rail bottom includes a plurality of container gas distribution slots 626.

The invert gassing rail includes an upper surface 628 having at least one cap gassing distribution slot 630 and a port block 632 having a cap port fitting 634. The fitting extends generally horizontally. The invert gassing rail includes a flange 636 for mounting to the curved transition rail bottom.

The invert gassing rail includes a mounting surface for receiving the mounting surface 640 of the inner curved longitudinally extending side gassing rail.

A bore 642 extends through the invert gassing rail generally between the outer side and the inner side of the gassing rail, the bore defining a fluid passage having an inlet 644 located at the outer side and an outlet 646 located at an area of the inner side. The outlet 646 located at the area of the inner side is located on the mounting surface of the invert gassing rail. The bore includes a manufacturing drill hole 648 at the inner side, the manufacturing drill hole is further threaded and receives a threaded plug 650, the invert gassing rail includes an orthogonal manufacturing opening which forms the outlet in fluid communication with the bore.

The two curved longitudinally extending side gassing rails each include a longitudinally extending case 652 having an infeed or proximal end and a discharge or distal end. The proximal end includes a notch 654 and provides a surface and threaded opening 656 for mounting on the mounting surface with a threaded fastener 658. The outer curved longitudinally extending side gassing rail includes a port fitting 660 which generally extends horizontally from the side gassing rail.

The curved transition rail bottom includes a plurality of container gas distribution slots 626, through holes 662 which receive a threaded fastener for securing a side gassing rail, through holes for receiving threaded fastener and nuts to secure the flange of the invert gassing rail to the curved transition rail bottom, threaded fasteners for securing rotating locking arms, and the rotating locking arms for securing the transfer gassing rail to the curved transition rail bottom.

The inner curved longitudinally extending side gassing rail 608 includes a mounting surface 640, an outlet 670, an inlet 672, and a fluid passage extending between the outlet and inlet, the inlet is located at the mounting surface. The outlet 646 located at the area of the inner side is located on the mounting surface of the invert gassing rail in fluid communication with the inlet 672 of the inner curved longitudinally extending side gassing rail, whereby the source of gas or steam coupled to the fitting 644 is directed to the outlet 646 and then to the inner curved longitudinally extending side gassing rail.

The invention claimed is:

1. A gassing rail for gas or steam flushing containers and caps on a rotary capping machine, the gassing rail defines an inner side and an outer side with respect to the rotary capping machine, the gassing rail comprising:

a substantially planar body;

an upper surface formed on the substantially flat planar body, the upper surface having at least one cap gas or steam distribution slot defining a longitudinally extending cap path, the cap gas or steam distribution slot includes an infeed end and an exit end;

a lower surface formed on the substantially flat planar body, the lower surface having at least one container gas or steam distribution slot defining a longitudinally extending container path, the container gas or steam distribution slot includes an infeed end and an exit end;

a bore extends through the gassing rail between the outer side and the inner side of the gassing rail, the bore defining a fluid passage having an inlet located at the outer side and an outlet located at an area of the inner side; and a fitting coupled to the inlet at the outer side, the fitting adapted to be coupled to a tubing supplying a source of gas or steam, whereby the source of gas or steam is routed from the outer side to the outlet at the inner side via the bore.

2. The gassing rail of claim 1, further comprising:

an outer curved longitudinally extending side gassing rails and an inner curved longitudinally extending side gassing rails, the two curved longitudinally extending side gassing rails face one another in a spaced apart relationship and extend away and downstream from the substantially planar body, defining a cap fastening area and further define the longitudinally extending cap path, the two curved longitudinally extending side gassing rails each include a proximal or infeed end and a distal or discharge end.

3. The gassing rail of claim 2, further comprising:

a fitting coupled to the outer curved longitudinally extending side gassing rail and adapted to be coupled to a tubing supplying a source of gas or steam;

a fitting coupled to the inner curved longitudinally extending side gassing rail;

a fitting coupled to the outlet at the inner side; and a tubing coupled between the fitting coupled to the outlet and the fitting coupled to the inner curved longitudinally extending side gassing rail, whereby the source of gas or steam is routed to the inner curved longitudinally extending side gassing rail via the bore.

4. The gassing rail of claim 3, wherein the two curved longitudinally extending side gassing rails each include a flange portion extending toward the infeed end and having a lower surface for mounting to the gassing rail, an outer surface having an inlet and at least one through hole, and inner side in a facing spaced apart relationship, the inner side including at least one longitudinally extending grove, the grove in fluid communication with the respective inlet, an element received by a respective inner side and secured via a respective frame and a fastener extending through a respective through hole.

5. The gassing rail of claim 2, further comprising:

a fitting coupled to the outer curved longitudinally extending side gassing rail and adapted to be coupled to a tubing supplying a source of gas or steam;

the inner curved longitudinally extending side gassing rail includes a mounting surface, an outlet, an inlet, and a fluid passage extending between the outlet and inlet, the inlet is located at the mounting surface;

the gassing rail includes a mounting surface for receiving the mounting surface of the inner curved longitudinally extending side gassing rail, the outlet located at the area of the inner side is located on the mounting surface of the gassing rail in fluid communication with the inlet of the inner curved longitudinally extending side gassing rail, whereby the source of gas or steam coupled to the fitting is directed to the outlet.

6. The gassing rail of claim 5, wherein the bore includes a manufacturing drill hole at the inner side, the manufacturing drill hole is further threaded and receives a threaded plug, the gassing rail includes an orthogonal manufacturing opening which forms the outlet in fluid communication with the bore.

7. The gassing rail of claim 2, wherein the rail includes a discharge end and further comprising an invert gas rail secured to the rail at the discharge end extending between the outer curved longitudinally extending side gassing rail and the inner curved longitudinally extending side gassing rail, the invert gas rail includes a fitting located on the outer side and in fluid communication with a mesh gas outlet located on an upper surface of the invert gas rail, whereby a source of gas or steam coupled to the fitting is directed to the mesh gas outlet.

8. The gassing rail of claim 2, further comprising:

an inner flange side gassing rail is coupled to the planar body along the inner side, the inner flange side gassing rail having at least one container gas or steam side distribution slot defining a longitudinally extending container path;

an outer flange side gassing rail is coupled to the planar body along the outer side, the outer flange side gassing rail having at least one container gas or steam side distribution slot defining a longitudinally extending container path;

wherein the gassing rail includes a zone providing the upper surface having at least one independent cap gas or steam distribution slot and the lower surface having at least one independent container gas or steam distribution slot, a first bore extending through the gassing rail for coupling gas or steam from the outer side to the inner curved longitudinally extending side gassing rail; and a second bore extending through the gassing rail for coupling gas or steam from the outer side to the container gas or steam side distribution slot of the inner flange side gassing rail.

9. The gassing rail of claim 8, wherein the gassing rail includes a plurality of zones, each zone providing at least one independent cap gas or steam distribution slot and at least one independent container gas or steam distribution slot, wherein a single bore is located between adjacent zones.

10. The gassing rail of claim 8, further comprising a case which includes at least one zone, each zone includes a cavity defined by a bottom wall, the at least one independent container gas or steam distribution slot in the bottom wall; the cavity receives a bottom gassing element for head space gassing; an insert is provided over the bottom gassing element, the insert includes an upper surface with an upper cavity formed in the upper surface, a groove is formed in the upper surface and extends from the upper cavity and is in fluid communication with a cap port, a through hole 188 extends through the insert and is in fluid communication with a container port and the bottom gassing element; a top gassing element is received by the upper cavity; a top cover is received and secured to the case over the top gassing element, the top cover provides the at least one independent cap gas or steam distribution slot.

11. A gassing rail for gas or steam flushing containers and caps on a rotary capping machine, the gassing rail defines an inner side and an outer side with respect to the rotary capping machine, the gassing rail comprising:

a substantially planar body;

an upper surface formed on the substantially flat planar body, the upper surface having at least one cap gas or steam distribution slot defining a longitudinally extending cap path, the cap gas or steam distribution slot includes an infeed end and an exit end;

a lower surface formed on the substantially flat planar body, the lower surface having at least one container gas or steam distribution slot defining a longitudinally extending container path, the container gas or steam distribution slot includes an infeed end and an exit end;

an inner flange side gassing rail is coupled to the planar body along the inner side, the inner flange side gassing rail having at least one container gas or steam side distribution slot defining a longitudinally extending container path; and an outer flange side gassing rail is coupled to the planar body along the outer side, the outer flange side gassing rail having at least one container gas or steam side distribution slot defining a longitudinally extending container path.

12. The gassing rail of claim 11, further comprising:

a bore extends through the gassing rail between the outer side and the inner side of the gassing rail, the bore defining a fluid passage having an inlet located at an area of the outer side and an outlet located at a mounting surface at an area of the inner side of the gassing rail;

the inner flange side gassing rail includes a mounting surface for receiving the mounting surface of the gassing rail, the inner flange side gassing rail having an inlet, the inlet is in fluid communication with the container gas or steam side distribution slot and the outlet located at the mounting surface at the area of the inner side of the gassing rail;

a fitting coupled to the inlet at the area of the outer side, the fitting adapted to be coupled to a tubing supplying a source of gas or steam, whereby the source of gas or steam is directed to the container gas or steam side distribution slot of the inner flange side gassing rail.

13. The gassing rail of claim 12, wherein the mounting surface of the gassing rail is located on the lower surface of the gassing rail, and the inner flange side gassing rail includes an upper surface having the mounting surface.

14. The gassing rail of claim 12, wherein the bore includes a manufacturing drill hole at the inner side, the manufacturing drill hole is further threaded and receives a threaded plug, the gassing rail includes an orthogonal manufacturing opening which forms the outlet in fluid communication with the bore and the inner flange side gassing rail.

15. The gassing rail of claim 12, wherein the bore includes a manufacturing drill hole at the outer side, the manufacturing drill hole is further threaded and receives a threaded plug, the gassing rail includes an orthogonal manufacturing opening extending upward and which forms the inlet in fluid communication with the bore and the fitting.

16. The gassing rail of claim 12, further comprising:

a second bore extends through the gassing rail between the outer side and the inner side of the gassing rail, the second bore defining a fluid passage having an inlet located at the outer side and an outlet located at an area of the inner side;

a fitting coupled to the inlet at the outer side, the fitting adapted to be coupled to a tubing supplying a source of gas or steam, whereby the source of gas or steam is routed to the outlet at the inner side via the second bore;

an outer curved longitudinally extending side gassing rails and an inner curved longitudinally extending side gassing rails, the two curved longitudinally extending side gassing rails face one another in a spaced apart relationship and extend away and downstream from the substantially planar body, defining a cap fastening area and further define the longitudinally extending cap path, the two curved longitudinally extending side gassing rails each include a proximal or infeed end and a distal or discharge end;

a fitting coupled to the inner curved longitudinally extending side gassing rail;

a fitting coupled to the outlet at the inner side; and a tubing coupled between the fitting coupled to the outlet and the fitting coupled to the inner curved longitudinally extending side gassing rail, whereby the source of gas or steam is routed to the inner curved longitudinally extending side gassing rail via the second bore.

17. The gassing rail of claim 11, wherein a fitting is coupled to the outer flange side gassing rail, the fitting is in fluid communication with the container gas or steam side distribution slot of the outer flange side gassing rail.

18. The gassing rail of claim 11, wherein the an inner flange side gassing rail extends in a longitudinal direction and includes an upper surface, lower surface, outer side and an inner side, wherein the at least one container gas or steam side distribution slot is located on the inner side.

19. The gassing rail of claim 18, wherein a groove extends along the inner side, the upper surface includes a mounting surface, an inlet is located on the upper surface, an outlet is formed in the groove and is in fluid communication with the inlet on the upper surface of the inner flange side gassing rail, wherein the inlet is in fluid communication with the container gas or steam side distribution slot.

20. The gassing rail of claim 11, wherein the inner flange side gassing rail and the outer flange side gassing rail each include an inner side, the two inner sides face one another in spaced apart relationship, each inner side includes a groove extending in a longitudinal direction, each groove receives an element having multiple layers.

21. The gassing rail of claim 20, wherein the inner flange side gassing rail and the outer flange side gassing rail each include a plurality of openings extending through the respective inner side to receive a fastener to secure the respective element within a frame, and a respective upper surface which includes a plurality of threaded openings to receive a fastener to connect the respective flange side gassing rail to the gassing rail.

22. The gassing rail of claim 11, further comprising:

wherein the gassing rail includes a zone providing the upper surface having at least one independent cap gas or steam distribution slot and the lower surface having at least one independent container gas or steam distribution slot, a first bore extending through the gassing rail for coupling gas or steam from the outer side to the inner curved longitudinally extending side gassing rail; and a second bore extending through the gassing rail for coupling gas or steam from the outer side to the container gas or steam side distribution slot of the inner flange side gassing rail.

23. The gassing rail of claim 22, wherein the gassing rail includes a plurality of zones, each zone providing at least one independent cap gas or steam distribution slot and at least one independent container gas or steam distribution slot, wherein a single bore is located between adjacent zones.

24. The gassing rail of claim 22, further comprising a case which includes at least one zone, each zone includes a cavity defined by a bottom wall, the at least one independent container gas or steam distribution slot in the bottom wall; the cavity receives a bottom gassing element for head space gassing; an insert is provided over the bottom gassing element, the insert includes an upper surface with an upper cavity formed in the upper surface, a groove is formed in the upper surface and extends from the upper cavity and is in fluid communication with a cap port, a through hole extends through the insert and is in fluid communication with a container port and the bottom gassing element; a top gassing element is received by the upper cavity; a top cover is received and secured to the case over the top gassing element, the top cover provides the at least one independent cap gas or steam distribution slot.

25. The gassing rail of claim 22, where the bore and second bore are located adjacent to one another at one end of a zone.

* * * * *